US006604261B2

(12) United States Patent
Stoll et al.

(10) Patent No.: US 6,604,261 B2
(45) Date of Patent: Aug. 12, 2003

(54) DRAFTING FRAME FOR A SPINNING MACHINE

(75) Inventors: Angelika Stoll, Köngen (DE); Daniel Friedrich, Marmoutier (FR)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 10/164,277

(22) Filed: Jun. 6, 2002

(65) Prior Publication Data

US 2002/0184737 A1 Dec. 12, 2002

(30) Foreign Application Priority Data

Jun. 8, 2001 (DE) ..... 101 27 741

(51) Int. Cl.[7] ..... D01H 5/00

(52) U.S. Cl. ..... 19/236; 19/244; 19/246; 57/315

(58) Field of Search ..... 19/150, 236–250, 19/252, 263, 286, 287, 288, 304–308; 57/264, 304, 315, 328, 333; 15/301, 312.1, 314, 256.51, 256.52, 256.53

(56) References Cited

U.S. PATENT DOCUMENTS

| | | | | |
|---|---|---|---|---|
| 6,158,091 | A * | 12/2000 | Olbrich et al. | 19/263 |
| 6,189,308 | B1 * | 2/2001 | Dinkelmann et al. | 57/76 |
| 6,202,398 | B1 * | 3/2001 | Dinkelmann et al. | 57/76 |
| 6,318,060 | B1 * | 11/2001 | Dinkelmann et al. | 57/3 |
| 6,341,484 | B2 * | 1/2002 | Dinkelmann et al. | 57/315 |

FOREIGN PATENT DOCUMENTS

| | | |
|---|---|---|
| DE | 41 39 067 | 6/1993 |
| DE | 43 23 472 | 7/1995 |
| DE | 198 15 325 | 10/1999 |
| DE | 198 46 268 | 10/1999 |

* cited by examiner

*Primary Examiner*—Gary L. Welch
(74) *Attorney, Agent, or Firm*—Herbert Dubno

(57) ABSTRACT

Downstream of the last roller pair of a drafting frame for a spinning machine, the roving is condensed in a fiber-bundling zone having a belt with perforations to which suction is applied. Another belt converges toward the belt with the perforations and engages the roving at a nip spaced from the nip formed by the last roller pair of the drafting frame so that the wedge-shaped converging of the two belts promotes the compacting or condensing action.

10 Claims, 2 Drawing Sheets

DRAFTING FRAME FOR A SPINNING MACHINE

FIELD OF THE INVENTION

Our present invention relates to a drafting frame for a spinning machine of the type in which a plurality of roller pairs draft a roving between them and consist of upper and lower rolls of which the upper rolls are usually mounted on a weighting member and wherein one or more of the rolls or roll pairs can be provided with a belt.

More particularly the invention relates to a drafting frame of this type which is provided with a pneumatic condensing or compacting unit in which the fibers of the roving are drawn together by pneumatic means as they pass along a perforated surface so that within a fiber bundling zone, fibers of the roving which may project outwardly are drawn together or bundled.

BACKGROUND OF THE INVENTION

A double-belt drafting frame is described in German patent document DE 43 23 472 C2 in which the roving upstream of the output pair of rollers of the drafting frame is engaged by a belt having a perforation and guided along suction shoes so that the fibers are bundled together into a thread. Over the output roller pair of the drafting frame a suction air stream is passed transversely to the transport direction over the length of the fiber bundling zone.

Another condensing or compaction system for a roving is shown in German patent document DE 198 46 268 A1. In this arrangement the drafting frame has at its output side a clamping roller which is driven by one of the output rollers of the drafting frame. The condensing zone is here formed by a hollow member forming a suction device and whose outer contour is a sliding surface over which a transport belt is looped.

Another apparatus within the art of such drafting units is the double-belt drafting frame of German patent document DE 41 39 067 C2 which is provided for a spinning machine and in which the fiber bundling zone has a pair of belts which pass around a roller pair and in which the roving is fed directly into the supply roll pair.

In general, these fiber bundling or condensing (compaction) systems have been found to be effective and the use of condensing units or fiber bundling units for rovings on drafting frames has become relatively widespread.

OBJECTS OF THE INVENTION

It is however an object of the present invention to improve upon the prior art systems previously described and, in particular, to provide a drafting frame for a spinning machine in which the condensation of the roving which is effected in the fiber bundling zone can be made more effective in a simple manner.

Another object of this invention is to provide an improved fiber bundling system for a drafting frame for use in or in conjunction with a spinning machine.

SUMMARY OF THE INVENTION

These objects and others which will become apparent hereinafter are attained, in accordance with the invention, in a drafting frame for a spinning machine which comprises:

a succession of spaced-apart roller pairs operating at different peripheral speeds and drafting a roving between the roller pairs, the succession of roller pairs having an output roller pair with an upper roller and a lower roller delivering the roving from a first nip between them; and a fiber bundling zone immediately downstream of the output roller pair for subjecting the delivered roving to suction for drawing fibers of the roving together, the fiber bundling zone being formed with:

a suction shoe juxtaposed with the roving and connected to a suction source, a perforated transport element looped around the suction shoe and supporting the roving while suction applied through the transport element condenses the roving by drawing fibers of the roving together, and an inclined belt converging toward the perforated transport element in a direction of travel of the roving through the fiber bundling zone and forming a second nip with the perforated transport element, the first and second nips delimiting upstream and downstream ends of the fiber bundling zone.

In other words the objects of the invention are achieved by providing the perforated transport medium in juxtaposition with a belt which converges toward the perforated transport medium to a second clamping location or nip. This belt provides a wedge action which has been found to improve the compaction or condensation of the roving in the region of the fiber bundling zone. The combination of the moving transport medium and the converging belt means that there are no stationary surfaces which can lead to uncontrolled fiber movements or, especially, to buckling. The roving and all of the fibers thereof are continuously displaced between the moving surfaces which prevent those uncontrolled movements and buckling. Optimum air flow conditions can be maintained as well and thus the consumption of air can be reduced.

In a drafting frame in which the second nip or the clamping location is defined by a perforated transport medium in the form of a lower belt toward which the upper belt converges, it is advantageous to provide the upper belt so that it runs toward the lower belt from a location upstream of the second nip and at which the height of the upper belt above the roving can be adjusted. This may be achieved by adjusting the member, here referred to as a rerouting element, about which the upper belt passes. The adjustability of this member allows the gap between the belts in the fiber-bundling zone to be optimally adjusted based upon the kind of staple fiber yarn which may be processed.

According to a feature of the invention, therefore, the perforated transport element is a lower belt passing around the suction shoe and a clamping roller located on a lower side of the second nip, the inclined belt being an upper belt passing around a rerouting element located at a distance from the lower belt at an upstream end of the zone and an upper clamping roller on an opposite side of the second nip.

The upper and lower belts form a wedge through which the roving passes and cleaning edge is provided downstream of the wedge. The lower belt can be looped around the cleaning edge.

Furthermore the lower roller can be located between the suction shoe and the cleaning edge.

According to another feature of the invention a drive roller bears upon the aforementioned lower roller for driving same.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
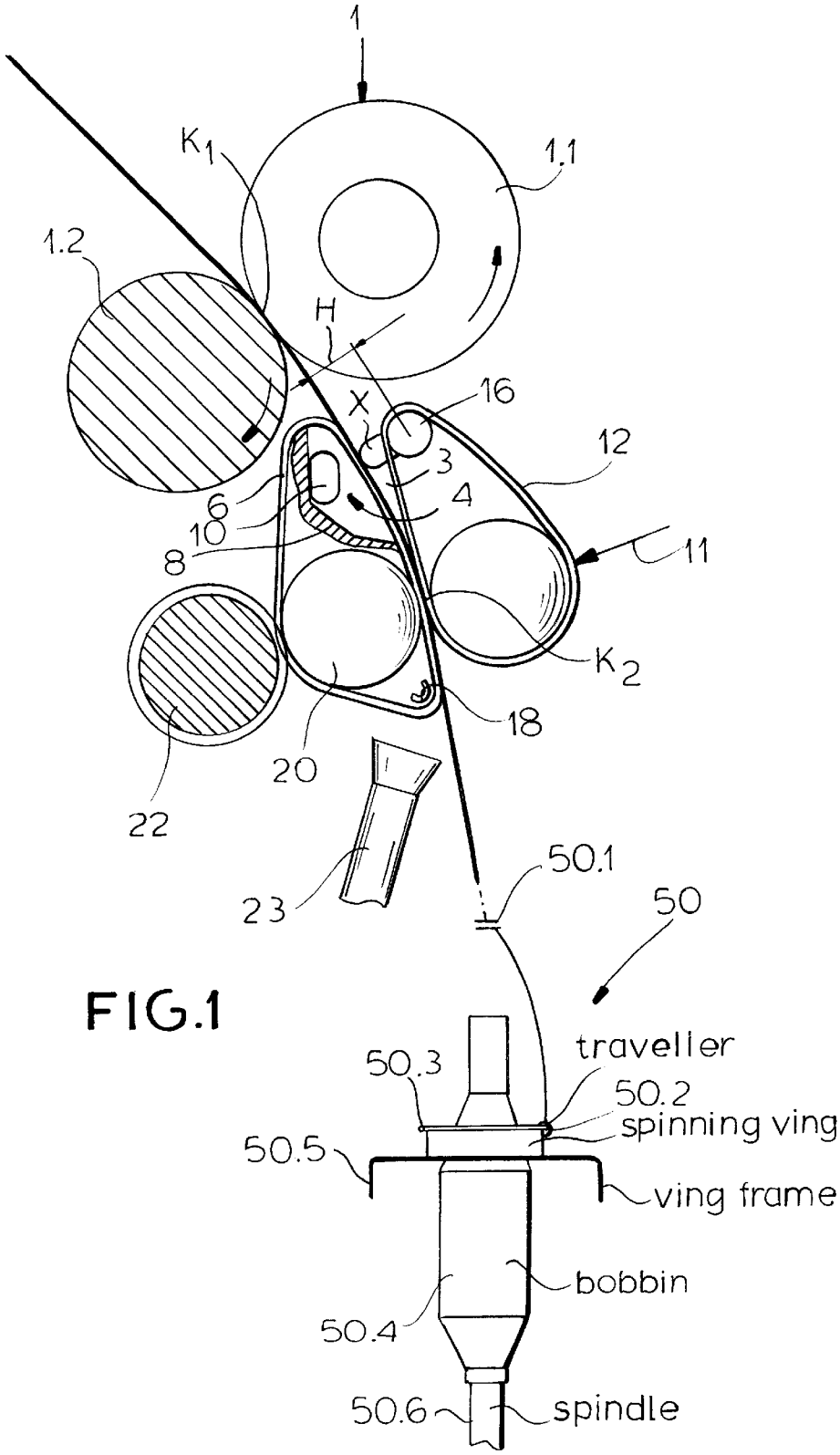
FIG. 1 is a schematic side elevational view, partly in section, through a drafting frame for a spinning machine.
Figure 2:
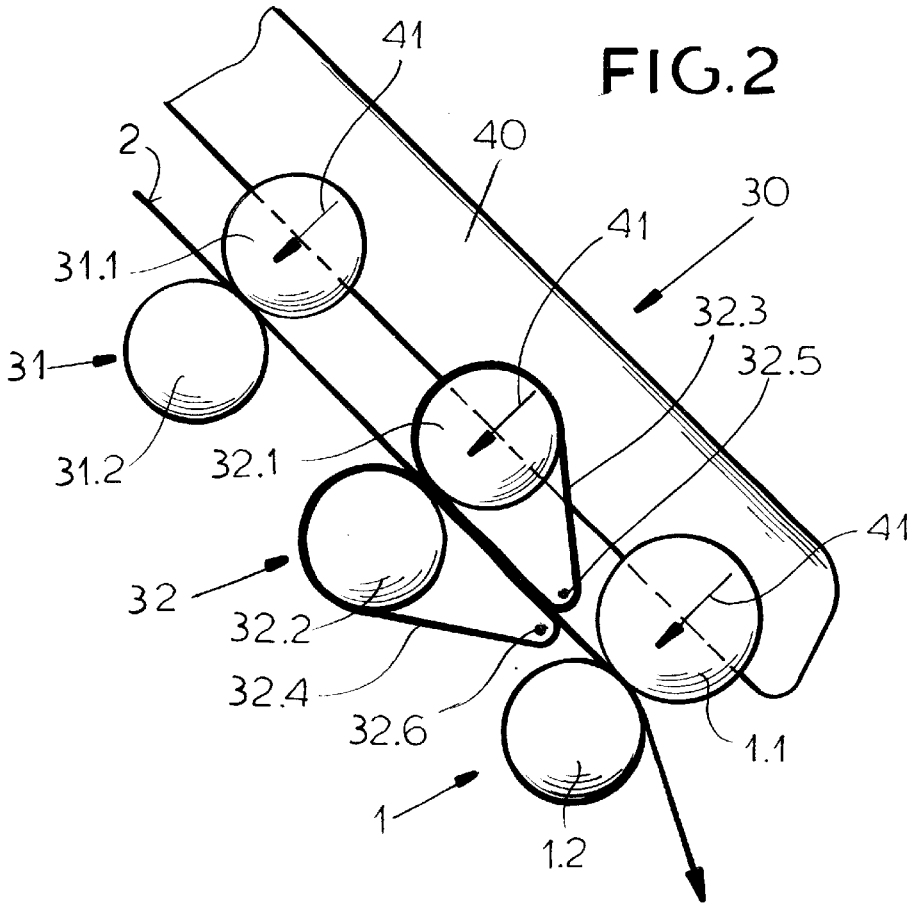
FIG. 2 is a diagram showing other parts of the drafting frame also seen from the side.

A drafting frame 30 for a spinning machine can comprise an inlet pair of rollers 31, consisting of upper and lower rollers 31.1 and 31.2, an intermediate pair of roller 32 consisting of upper rollers 32.1 and 32.2 and 33.2 and a final pair of rollers 1 consisting of rollers 1.1 and 1.2.

The rollers 32.1 and 32.2 may be looped by belts 32.2 and 32.4 guided around rerouting members 32.5 and 32.6, respectively. Any of the roller pairs 31, 32 may be provided with such belts.

The roller pairs are driven at increasingly greater peripheral speeds so that the roving 2 is drafted between pairs of rollers.

The lower rollers 31.2, 32.2, 1.2 may be common to a multiplicity of spinning stations and can extend over a substantial number of spinning positions and rovings along the respective sides of the spinning machines, while the upper rollers 31.1, 32.1, and 1.1 can be mounted via spring 41 on arms 40 which are weighted toward the lower rollers. The rollers 31.1, 32.1 and 1.1 can be twinned on each arm 40 so that one roller engages one roving 2 while the other corresponding roller on that arm engages another roving destined for the same spinning station or for another spinning station.

The invention is directed principally to the condensation of the roving between the last or output roller pair 1 for the respective roving 2 and the spinning machine.

Thus, as can be seen from FIG. 1, each output roller pair 1 having an upper roller 1.1 and a lower roller 1.2 defines a first nip or clamping location $K_1$ bundling the upstream end of a fiber bundling zone 3 so that, downstream of each output roller pair 1, a respective fiber bundling zone 3 is located.

Figure 3:
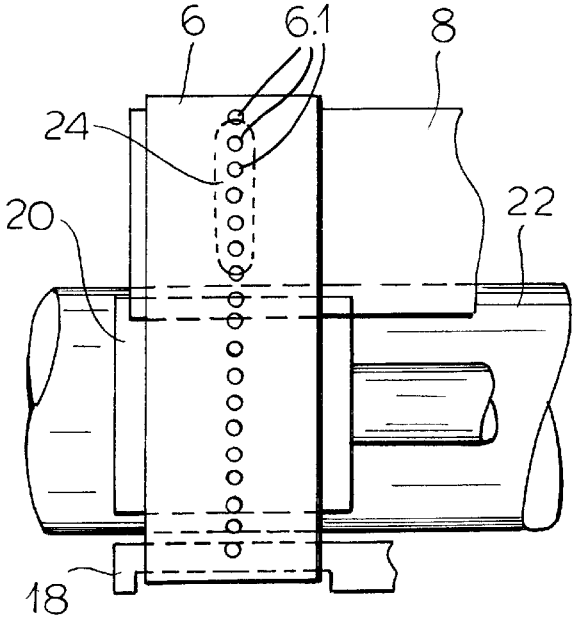
FIG. 3 is a front view showing the perforations of the perforated belt.

The fiber bundling zones each have a pneumatic condensing or compaction device 4 with a perforated transport belt 6, the perforations of which are shown as respective orifices 6.1 (FIG. 3) in a narrow row on the respective belt. The belt 6 is looped around a suction shoe 8 to form a lower belt which extends over the greater part of the length of the fiber bundling zone from the clamping location $K_1$ to a clamping location $K_2$. The suction shoe 8 is connected to a suction source which can be a manifold connected in turn to an intake of a suction pump. The shoe can have a narrow suction slit 24 over which the row of perforations 6.1 are guided.

As is apparent from FIG. 1, moreover, the fiber bundling zone 3 is bounded by the two clamping locations $K_1$, $K_2$. The first clamping location $K_1$ or nip is defined between the two rollers 1.1 and 1.2 of the output roller pair. The downstream clamping location $K_2$ or nip is defined between the rollers 14 and 20, the latter being looped by the belt 6 while the former has a belt 12 looped therearound. The weighting of the upper roller 14 against the lower roller 20 is here represented by the arrow 11.

The force 11 may be generated by the arm 40 mentioned previously and can be applied to the roller 14 via a spring (not shown).

The lower roller 20 can be driven by a drive roller 22 which, like the rollers 31.2, 32.2 and 1.2 may extend the length of the drafting frame. In this case the condensing unit is driven by friction from the drive roller 22.

According to the invention, the lower belt 6, i.e. the perforated transport medium, is juxtaposed with the belt 12 whose lower pass converges toward the belt 6 to the second clamping location $K_2$ to form a wedge-shaped gap therewith. The belt 12 is looped around a rerouting element 16 at the upstream end and that element is adjustable by an adjusting element x to vary the height H of the upstream end of the belt 12 above the lower belt 6. The adjusting element may be a replaceable spacer of a selected length braced between the shoe 8 and the rerouting element 16.

As a consequence the condensing unit shown in FIG. 1 is a double-belt unit having a lower belt 6 and an upper belt 12 between which a wedge action is effected in the fiber bundling zone 3. Downstream of the nip $K_2$, a cleaning edge 18 is provided around which the lower belt 6 is guided.

In the fiber-bundling zone suction is applied through the perforation 6.1 via the suction source 10 and the suction shoe 8. The result is a condensation of the fibers of the roving, regardless of how they may have protruded prior to condensation, into a compact thread. The joint action of the belts 6 and 12 and the wedge-shaped convergence of them provides the advantage that the wedge promotes fiber bundling and condensation significantly. Downstream of the fiber-bundling zone, the cleaning edge 18 serves to remove any fibers which may adhere to the belt and enable them to be sucked off through a suction pipe 23. The spinning unit itself has been represented at 50 in FIG. 1 and may be a ring-spinning frame.

The spinning frame 50 can include the roving guide eye 50.1 from which the roving passes around the traveller 50.2 onto the bobbin 50.4. The bobbin 50.4 is mounted on a spindle 50.6 and the traveller orbits around the bobbin on a spinning ring 50.3 of a ring frame 50.5 which is displaceable relative to the bobbin.

We claim:

1. A drafting frame for a spinning machine comprising:

a succession of spaced-apart roller pairs operating at different peripheral speeds and drafting a roving between the roller pairs, said succession of roller pairs having an output roller pair with an upper roller and a lower roller delivering the roving from a first nip between them; and a fiber bundling zone immediately downstream of said output roller pair for subjecting the delivered roving to suction for drawing fibers of the roving together, said fiber bundling zone being formed with:

a suction shoe juxtaposed with said roving and connected to a suction source, said suction shoe forming an outwardly vaulted sliding surface for said roving and having a suction slot, an elongated perforated flexible transport belt looped around said suction shoe on said sliding surface and supporting said roving while suction applied through perforations of said transport belt and said suction slot condenses said roving by drawing fibers of said roving together, and an inclined flexible belt converging toward said perforated transport belt in a direction of travel of said roving through said fiber bundling zone and forming a second nip with said perforated transport belt, said first and second nips delimiting upstream and downstream ends of said fiber bundling zone.

2. A drafting frame for a spinning machine comprising:

a succession of spaced-apart roller pairs operating at different peripheral speeds and drafting a roving between the roller pairs, said succession of roller pairs having an output roller pair with an upper roller and a lower roller delivering the roving from a first nip between them; and a fiber bundling zone immediately downstream of said output roller pair for subjecting the delivered roving to suction for drawing fibers of the roving together, said fiber bundling zone being formed with:

a suction shoe juxtaposed with said roving and connected to a suction source, a perforated transport element looped around said suction shoe and supporting said roving while suction applied through said transport element condenses said roving by drawing fibers of said roving together, and an inclined belt converging toward said perforated transport element in a direction of travel of said roving through said fiber bundling zone and forming a second nip with said perforated transport element, said first and second nips delimiting upstream and downstream ends of said fiber bundling zone, said perforated transport element being a lower belt passing around said suction shoe and a clamping roller located on a lower side of said second nip, said inclined belt being an upper belt passing around a rerouting element located at a distance from said lower belt at an upstream end of said zone and an upper clamping roller on an opposite side of said second nip.

3. The drafting frame defined in claim 2 wherein said distance is adjustable.

4. The drafting frame defined in claim 3 wherein said upper and lower belts form a wedge through which said roving passes, said drafting frame further comprising a cleaning edge downstream of said wedge.

5. The drafting frame defined in claim 4 wherein said lower belt is looped around said cleaning edge.

6. The drafting frame defined in claim 5 wherein said lower roller is located between said suction shoe and said cleaning edge.

7. The drafting frame defined in claim 6, further comprising a drive roller bearing on said lower roller for driving same.

8. A drafting frame for a spinning machine comprising:

a succession of spaced-apart roller pairs operating at different peripheral speeds and drafting a roving between the roller pairs, said succession of roller pairs having an output roller pair with an upper roller and a lower roller delivering the roving from a first nip between them; and a fiber bundling zone immediately downstream of said output roller pair for subjecting the delivered roving to suction for drawing fibers of the roving together, said fiber bundling zone being formed with:

a suction shoe juxtaposed with said roving and connected to a suction source, a perforated transport element looped around said suction shoe and supporting said roving while suction applied through said transport element condenses said roving by drawing fibers of said roving together, and an inclined belt converging toward said perforated transport element in a direction of travel of said roving through said fiber bundling zone and forming a second nip with said perforated transport element, said first and second nips delimiting upstream and downstream ends of said fiber bundling zone, said belts forming a wedge through which said roving passes, said drafting frame further comprising a cleaning edge downstream of said wedge, said transport belt being looped around said cleaning edge.

9. The drafting frame defined in claim 8, further comprising a clamping roller located between said suction shoe and said cleaning edge and forming said second nip.

10. The drafting frame defined in claim 9, further comprising a drive roller bearing on said clamping roller for driving same.

* * * * *